US008006864B2

(12) United States Patent
Fryan et al.

(10) Patent No.: US 8,006,864 B2
(45) Date of Patent: Aug. 30, 2011

(54) WIPES DISPENSER

(75) Inventors: Michael C. Fryan, Racine, WI (US); Douglas A. Soller, Racine, WI (US); Rakesh K. Popli, Franksville, WI (US); Frank J. Steer, Racine, WI (US); Evan A. Sparks, Madison, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 136 days.

(21) Appl. No.: 12/204,866

(22) Filed: Sep. 5, 2008

(65) Prior Publication Data

US 2009/0057331 A1 Mar. 5, 2009

Related U.S. Application Data

(60) Provisional application No. 60/970,093, filed on Sep. 5, 2007.

(51) Int. Cl.

| | |
|---|---|
| ***A47F 1/00*** | (2006.01) |
| ***B67D 1/07*** | (2006.01) |
| ***B67D 7/06*** | (2006.01) |
| ***B65H 3/00*** | (2006.01) |
| ***G07F 11/00*** | (2006.01) |

(52) U.S. Cl. ..... 221/96; 221/102; 206/233; 206/38; 206/449; 222/192; 222/321.7; 222/321.9; 222/383.1; 239/52; 239/34

(58) Field of Classification Search ..... 206/233, 206/38, 449; 221/96, 102; 222/192, 321.7, 222/321.9, 383.1; 239/52, 34
See application file for complete search history.

(56) References Cited

U.S. PATENT DOCUMENTS

| | | | | |
|---|---|---|---|---|
| 3,189,228 | A * | 6/1965 | Steinbart | 222/129 |
| 3,980,203 | A * | 9/1976 | Dearling | 221/96 |
| 4,598,664 | A * | 7/1986 | Hamlin | 118/325 |
| 5,439,104 | A * | 8/1995 | Wolska-Klis | 206/233 |
| 5,887,759 | A * | 3/1999 | Ayigbe | 222/192 |
| 5,887,859 | A * | 3/1999 | Hadano et al. | 267/141.1 |
| 6,085,889 | A | 7/2000 | Thorsbakken | |
| 6,321,937 | B1 * | 11/2001 | DeSimone et al. | 221/45 |
| 6,457,434 | B1 | 10/2002 | Lazar | |
| 6,789,695 | B1 * | 9/2004 | Gaudreau | 221/102 |
| 7,018,473 | B2 * | 3/2006 | Shadrach, III | 118/315 |
| 7,222,747 | B1 | 5/2007 | Savran | |
| 7,370,754 | B2 * | 5/2008 | Kushner | 206/38 |
| 7,497,351 | B2 * | 3/2009 | Amundson et al. | 221/96 |
| 2003/0201004 | A1 * | 10/2003 | Cooley | 134/195 |
| 2005/0244211 | A1 | 11/2005 | Brunner et al. | |

OTHER PUBLICATIONS

PCT/US2008/010400 International Search Report and Written Opinion dated Oct. 28, 2009.

* cited by examiner

*Primary Examiner* — Gene Crawford
*Assistant Examiner* — Rakesh Kumar

(57) ABSTRACT

Portable wipe dispensers are provided. In one form the wipe dispenser can be used to spray a cleaning liquid onto a wipe being dispensed from the device. Alternatively the outlet may be directed against a surface external to the dispenser.

8 Claims, 6 Drawing Sheets

WIPES DISPENSER

CROSS-REFERENCE TO RELATED APPLICATIONS

This application claims priority based on U.S. provisional application 60/970,093 filed on Sep. 5, 2007.

STATEMENT REGARDING FEDERALLY SPONSORED RESEARCH/DEVELOPMENT

Not applicable.

BACKGROUND OF THE INVENTION

The present invention relates generally to wipe dispensing systems. More particularly, the present invention relates to wipe dispensing systems that allow a consumer to selectively apply a cleaning chemical to the wipe, or alternatively to a surface external to the dispenser and/or alternatively dispense dry wipes.

Wipes may be treated with detergent, other hard surface cleaners, polishes, waxes and other liquid materials. For example, so called "baby wipes" are treated with a mild cleaning agent or other substance for cleaning a baby's skin. Such wipes are generally packaged into a container like that of U.S. Pat. No. 5,803,249 from which the wipes can be dispensed.

However, pre-impregnating the wipe with the liquid requires the dispensing container to have structures which prevent the wipes from drying out prior to use. Further, typically all wipes within a container, when there is impregnation, are similarly impregnated. One may desire to have more flexibility. For example, for some situations a dry wipe may suffice. For other situations a small amount of impregnation is optimal. For still others a very wet wipe is desired.

A variety of products have been developed in which a dispenser dispenses both a sprayed fluid and a wipe. See e.g. U.S. Pat. Nos. 3,980,203, 4,598,664, 5,439,104, 6,085,899, 6,457,434 and 7,018,473. Each of these systems is deficient in some respect. For example, it is typical for the sprayer not to be usable to spray a hard surface directly, or not be well positioned to impregnate the wipe.

It can therefore be seen that improvements are desired with respect to portable wipes dispensers.

BRIEF SUMMARY OF THE INVENTION

In one aspect the invention provides a portable wipes dispenser comprising a housing having an internal cavity, a container (e.g. a spray bottle, a collapsible bag, or other reservoir) retained by the housing, and a supply of wipe material positioned in the cavity.

The container has an outlet and an internal area suitable to retain a liquid. When a spray bottle is used the outlet is preferably in a spray head that extends externally of the housing, such that if a liquid is stored in the spray bottle and a consumer moves the spray head it can cause the liquid to be delivered from the bottle and sprayed out the outlet. The spray head, and thus the outlet, can preferably pivot on an essentially vertically axis to provide additional flexibility in directing the spray. The bottle may also be linked to a pump sprayer.

The container is preferably mounted on a ledge above the supply of wipe material, in the internal cavity, and a first door is preferably provided to retain the spray bottle in the cavity.

The supply of wipe material is preferably in the form of a roll, and the wipes are positioned within the cavity such that a portion of the wipe material is capable of being moved (e.g. dragged) in front of the outlet. A second door can be pivotably mounted on the housing and act to cover the stored wipe material and the first door. The second door may also contain a hole to facilitate manual movement of the wipe material.

In one embodiment the spray bottle contains a cleaning liquid stored therein, such as a hard surface cleaner (e.g. an anti-bacterial counter top cleaner; a window cleaner), and the wipe material may be suitable to be used to wipe the intended surface. For example, the wipe may be made of fibers of rayon, cellulosic material, polypropylene or polyester, such as microfibers made from polyester, polypropylene or polyamide, and the cleaning liquid may be Windex® brand window cleaner.

In alternative embodiments at least a portion of the wipe material can be impregnated with a chemical that is not present in the cleaning liquid that is stored in the spray bottle. If the cleaning liquid in the spray bottle is sprayed on the impregnated wipe, a chemical reaction will be caused thereby. For example, components of a two-part bleach system could be activated in this manner where one of the components would be incompatible with the particular wipe material if stored for long periods.

The dispenser is preferably configured such that when a liquid is present in the spray bottle the spray bottle can direct the liquid against a portion of the wipe material as it is dragged across the outlet, or directly against a surface external to the dispenser if the wipe material is not at that position.

Note that the dispenser is compact, portable, and can be constructed from inexpensive plastics (apart from the cleaning liquid).

The foregoing and other advantages of the present invention will be apparent from the following description. In that description reference is made to the accompanying drawings which form a part thereof, and in which there is shown by way of illustration, and not limitation, preferred embodiments of the invention. Such embodiments do not necessarily represent the full scope of the invention.

DETAILED DESCRIPTION OF THE INVENTION

Figure 1:
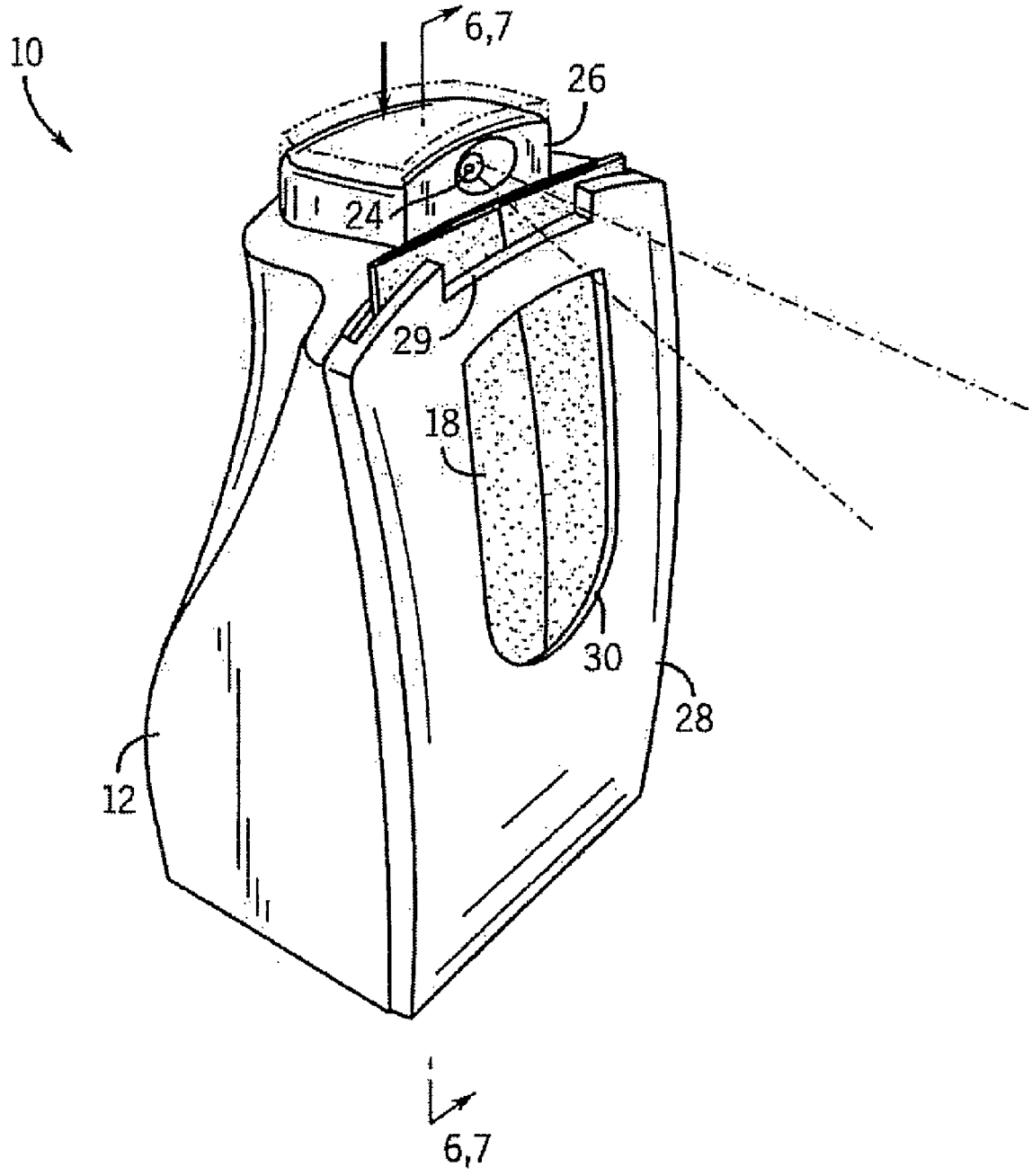
FIG. 1 is a left, frontal perspective view of a wipes dispenser of the present invention.
Figure 2:
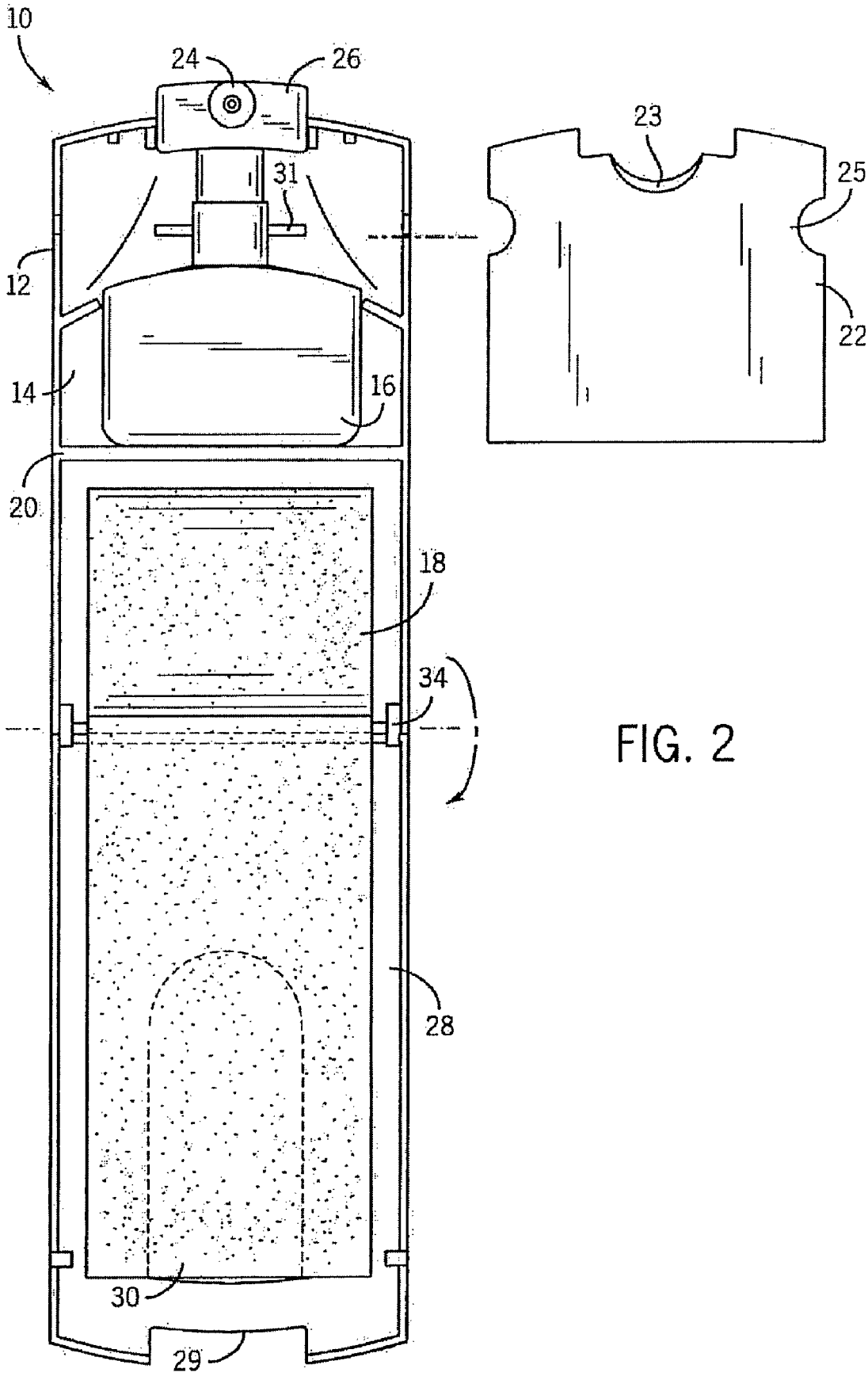
FIG. 2 is a front elevational view of the FIG. 1 dispenser, but with a first door separated from the housing, and with a second door pivotably opened to expose the wipe material.
Figure 3:
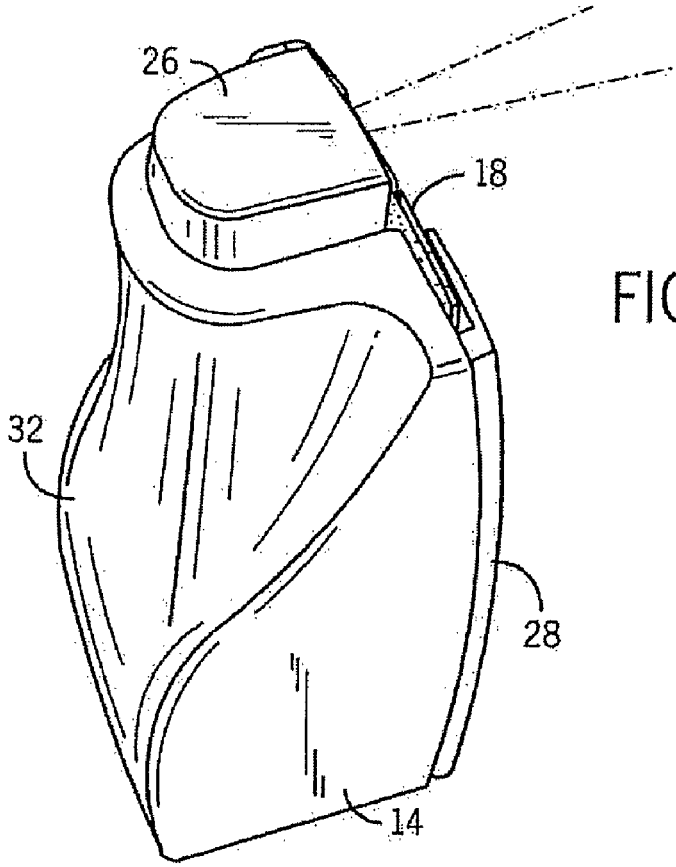
FIG. 3 is a rear, top perspective view of the portable wipes dispenser of FIG. 1.
Figure 4:
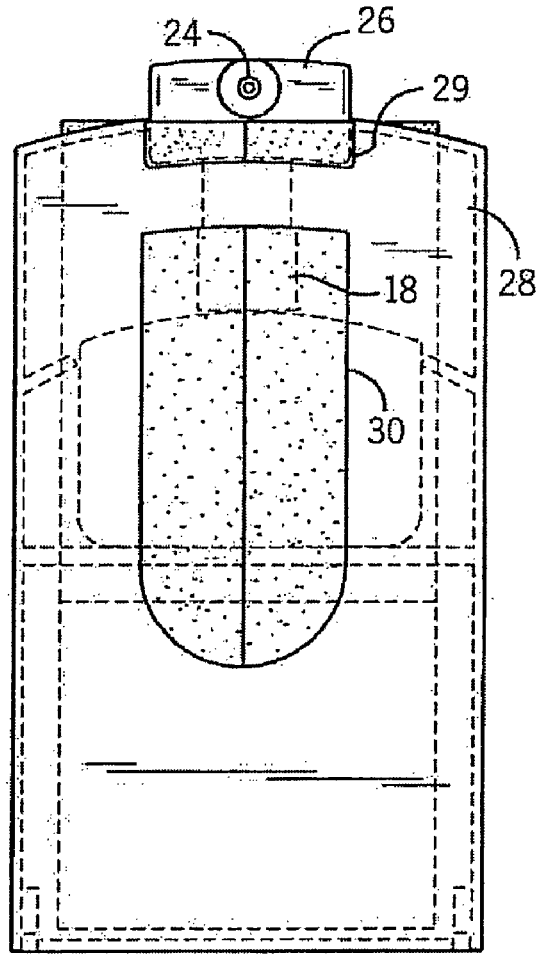
FIG. 4 is a front elevational view of the portable wipes dispenser of FIG. 1, with all covers present.

The drawings depict a wipes dispenser 10 having a housing 12 having an internal cavity 14, a container in the form of a spray bottle 16 positioned in the cavity 14, and a supply (e.g. a stack or roll) of wipe 18 also positioned in the cavity 14.

The spray bottle 16 is mounted on a ledge 20 that is positioned above the supply of wipe 18. The bottle 16 has an outlet 24 and an internal area suitable to retain a liquid (not shown).

The outlet 24 is positioned in a spray head 26 that extends externally of the housing 12, and is linked to a conventional pumping assembly. If a liquid is stored in the spray bottle 16 and a consumer depresses the spray head 26 it can cause the liquid to be delivered from the bottle 16 and sprayed out the outlet 24.

A first door 22 retains the spray bottle 16 in the cavity 14. The first door 22 contains opposing c-shaped openings 25 configured to releasably engage the housing 12 around the spray bottle 16. The first door 22 also contains a finger-shaped wedge 23 positioned just beneath the outlet 24 to facilitate a consumer's removal of the first door 22 from the housing 12, thereby allowing a consumer to replace or refill the spray bottle 16. The spray bottle 16 may be further secured in place within the cavity 14 with additional supports 31, which act to brace the spray bottle 16 against the rear wall 32 of the housing 12.

A second door 28 is pivotably mounted on a hinge 34 of the housing 12, and covers the wipe 18 and the first door 22. The second door 28 contains a rectangular cutout 29 along the edge of the second door 28 closest to the outlet 24 to facilitate a consumer's access to the wipe 18. The second door 28 also contains a hole 30 to facilitate manual movement of the individual wipes 18 as they are dispensed.

Figure 5:
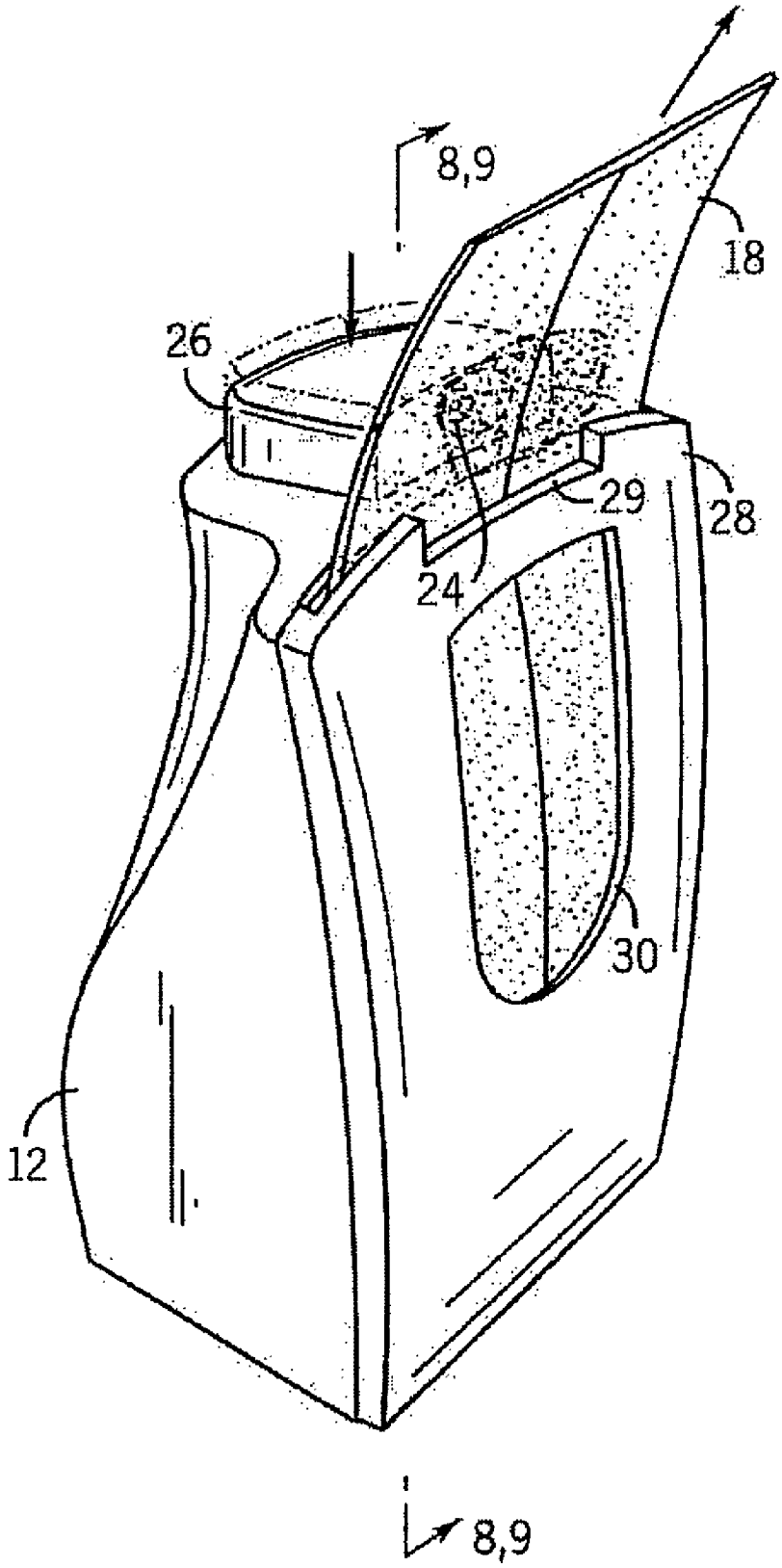
FIG. 5 is a view similar to FIG. 1, but with a wipe being pulled from the dispenser.
Figure 6:
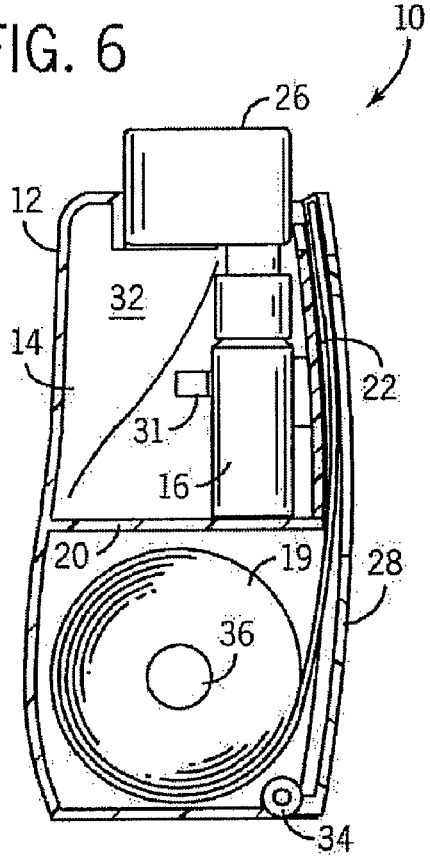
FIG. 6 is a sectional view taken along line 6-6 of FIG. 1.
Figure 7:
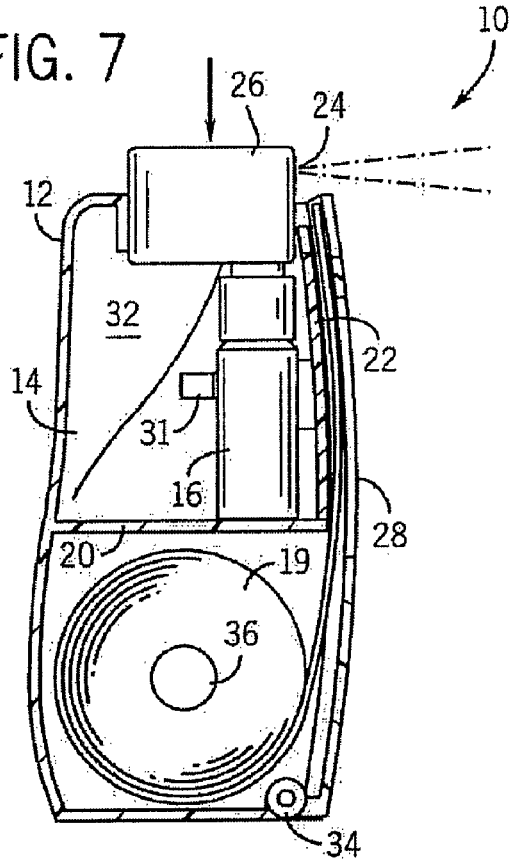
FIG. 7 is a view similar to FIG. 6, but with the pump sprayer depressed and fluid being sprayed before a wipe has been pulled up.
Figure 8:
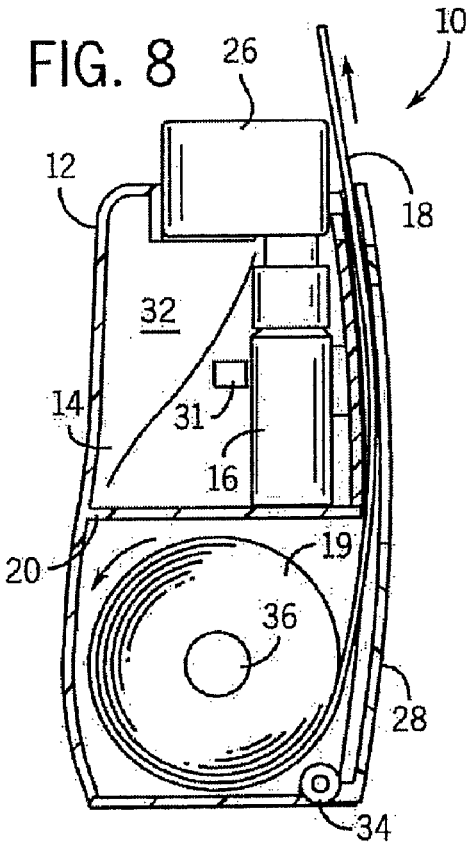
FIG. 8 is a view similar to FIG. 6, but with a wipe being dispensed without a spray.
Figure 9:
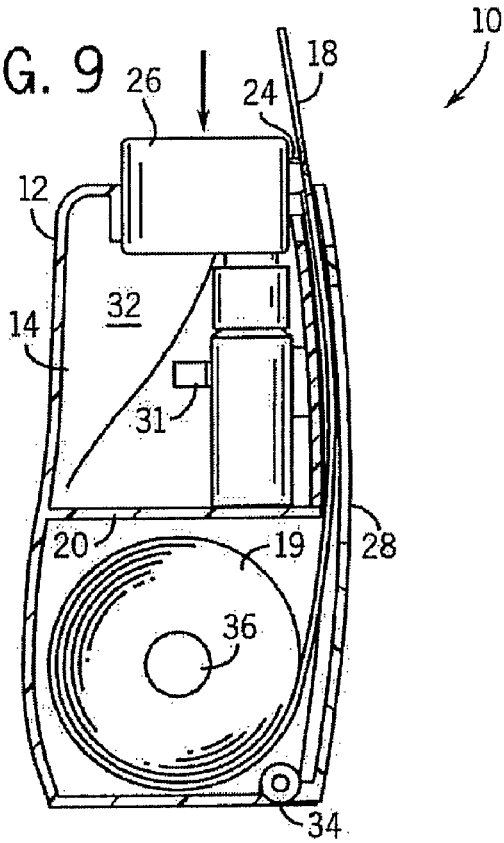
FIG. 9 is a view similar to FIG. 8, but with the pump sprayer depressed so as to impregnate the dispensed wipe.

As seen in FIG. 5, an individual wipe 18 may be removed from the dispenser 10 by moving between the second door and the first door 22 and past the outlet 24. A consumer may or may not decide to depress the spray head 26 before the wipe is moved out, and/or as the wipe 18 is being moved past the outlet 24. In this manner, the consumer can decide whether to wet a hard surface such as a window, whether to also or alternatively wet the wipe, and how much wetness is necessary at each function. For instance, a wipe 18 may be sprayed multiple times before being completely removed from the dispenser 10.

As may be understood by comparing FIGS. 6-9 the supply of wipe material may be in the form of a roll 19, and the roll of wipes 18 can be rotated around a roller 36 positioned within the cavity 14 of the dispenser 10. Of course, even when a roll of wipes is used roller 36 is not critical, and may be eliminated. In any event, the roll of wipes 18 are positioned within the cavity 14 such that a portion of the wipe 18 is capable of being moved in front of the outlet 24.

It is most preferred to leave the wipes dry prior to passing the outlet. However, one may alternatively impregnate the wipe with a material such as sodium bicarbonate, and then have the sprayer spray an acidic product on it. When combined on the wipe they react to form a foam that facilitates cleaning when the acidic product contains a foaming surfactant.

Alternatively, the wipes can be impregnated with an acidic formulation and the sprayer would spray a basic solution that causes the release of heat by virtue of neutralization, which exothermic reaction warms the wipe to facilitate cleaning.

Figure 10:
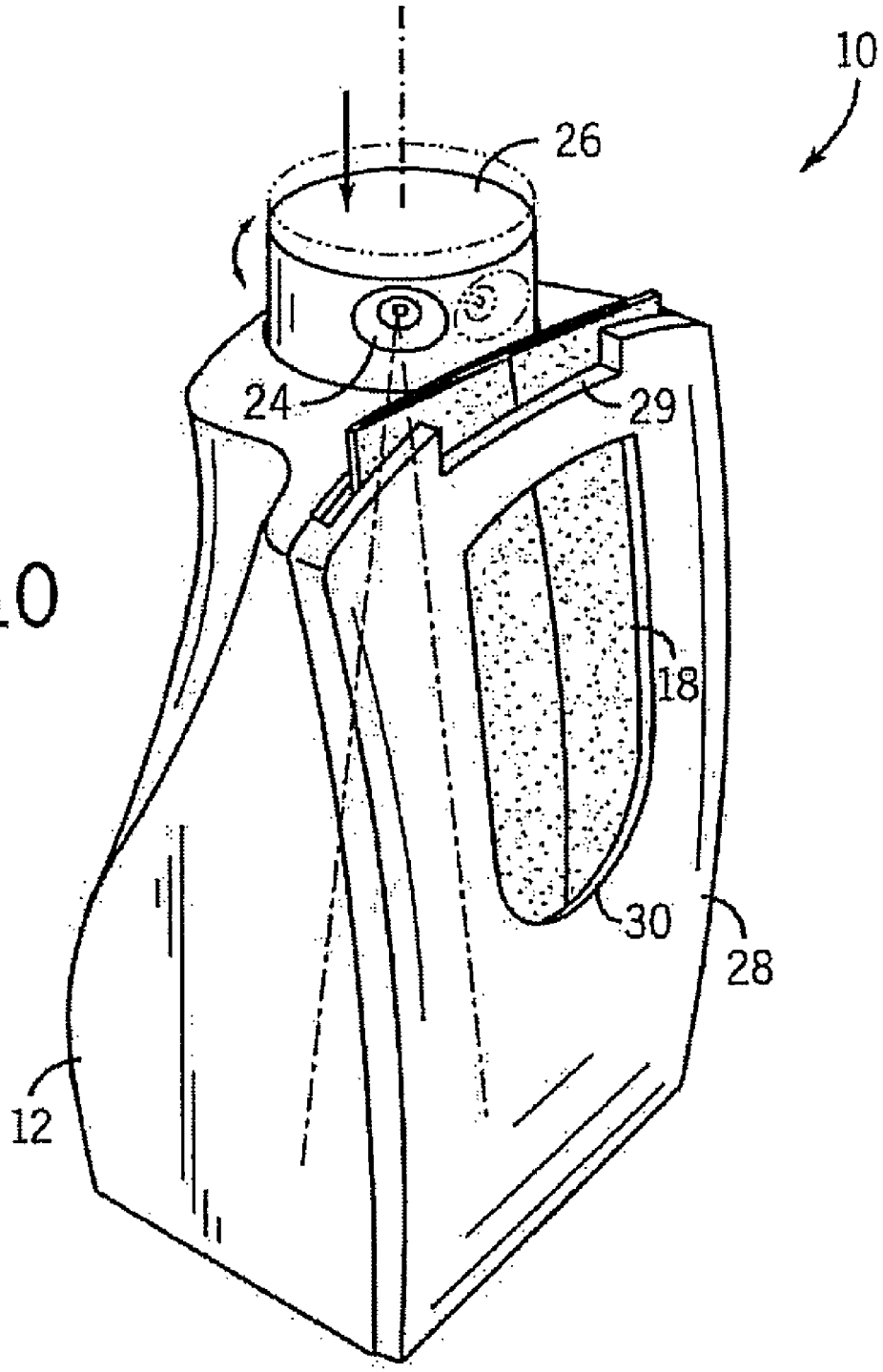
FIG. 10 is a view similar to FIG. 1, but showing the spray head rotated on an essentially vertical axis to direct a spray differently.

As seen in FIG. 10, the spray head 26, and thus the outlet 24 can pivot on an essentially vertically axis. In this manner, the dispenser 10 is configured such that when a liquid is present in the spray bottle 16 the spray bottle 16 can direct the liquid against a portion of the wipe 18. Alternatively, the outlet 24 may be directed against a surface external to the dispenser 10 (not shown). Further alternatively, the door 28 can be pivoted down even once the wipe has started to be pulled to allow continued spraying apart from the wipe. Accordingly, the consumer is allowed to determine the best use of the wipe 18 and spray.

While embodiments of the present invention have been described, other embodiments of the invention within the spirit and scope of this disclosure. For example, the wipe could be treated with a basic solution such that when a sprayer sprays a peroxide solution onto it the pH of the peroxide solution is raised from neutral to 9 or above. This optimizes the peroxide's ability to clean without requiring long-term storage of the peroxide at a pH that would destabilize it.

Another example would be that the sprayer bottle could be replaced with a collapsible bag linked to a fixture that allows the consumer to puncture the bag with a tip of a pump sprayer dip tube. An appropriate seal could be provided at the puncture point.

Further, the rear of the housing 12 could be provided with a hook or eyelet to facilitate hanging of the device between uses on a nail or the like. Also, the roll of paper could be replaced with a linked stack of paper. Moreover, sprayer bottle 16 could be of a type that could be removed from the housing and separately used for small spaces.

Hence, the claims, when presented, should not be construed as being limited to just the disclosed preferred embodiments.

INDUSTRIAL APPLICABILITY

The present invention provides devices for dispensing wipes and/or spray in a consumer-controlled fashion.

What is claimed is:

1. A dispenser comprising:

a housing having an internal cavity;

a container retained by the housing, the container having an outlet and an internal area suitable to retain a liquid;

a supply of wipe material retained in the cavity such that a portion of the wipe material is capable of being moved in front of the outlet;

wherein the dispenser is configured such that the container outlet faces the wipe material and that when a liquid is present in the container the container can direct the liquid against a portion of the wipe material when the wipe material is in a first position across the container outlet, or directly against a surface external to the dispenser when wipe material is in a second position;

wherein there is a first door for retaining the container in the cavity and a second door that is pivotably mounted on the housing to cover stored wipe material and also cover the first door, the dispenser being configured to guide movement of the wipe material towards and across the container outlet as the wipe material is moved out of the housing;

wherein there is a hole through the second door to facilitate manual movement of the wipe material; and wherein there is a also cutout along an upper edge of the second door to facilitate gripping of the wipe material.

2. The dispenser of claim 1, wherein the container is a reservoir portion of a spray bottle.

3. The dispenser of claim 1, wherein the container is mounted on a ledge, the ledge being positioned above the supply of wipe material, in the internal cavity.

4. The dispenser of claim 3, wherein the supply of wipe material is in a form of a roll.

5. The dispenser of claim 1, wherein the outlet is positioned in a spray head linked to the container that extends externally of the housing, such that if a liquid is stored in the container and a consumer depresses the spray head it can cause the liquid to be delivered from the container and sprayed out the outlet.

6. The dispenser of claim 5, wherein the spray head can pivot on a vertical axis.

7. The dispenser of claim 1, wherein the container is linked to a pump sprayer.

8. The dispenser of claim 1, in which the container stores a hard surface cleaner chemical and the wipe material is suitable to be used to wipe a hard surface.

* * * * *